US005611673A

United States Patent [19]

Agata

[11] Patent Number: 5,611,673

[45] Date of Patent: Mar. 18, 1997

[54] VACUUM JET PUMP FOR RECOVERING A MIXED FLUID OF GAS AND LIQUID CONDENSATES FROM STEAM-USING APPARATUS

[75] Inventor: Akihiko Agata, Isahaya, Japan

[73] Assignee: Shin-Ei Kabushiki Kaisha, Isahaya, Japan

[21] Appl. No.: 624,752

[22] Filed: Mar. 27, 1996

Related U.S. Application Data

[63] Continuation of Ser. No. 277,210, Jul. 19, 1994, abandoned.

[51] Int. Cl.[6] ..... F04F 5/44

[52] U.S. Cl. ..... 417/198; 417/151; 239/433

[58] Field of Search ..... 239/433; 417/79, 417/87, 198, 197, 151, 76

[56] References Cited

U.S. PATENT DOCUMENTS

| | | | |
|---|---|---|---|
| 919,266 | 4/1909 | Tomlinson | 417/76 |
| 1,751,719 | 3/1930 | Uhri | 417/198 |
| 2,382,391 | 8/1945 | Berman | 417/198 |
| 2,707,021 | 4/1955 | Harris | 417/76 |
| 2,802,337 | 8/1957 | Bunch | 417/79 |
| 3,445,335 | 5/1969 | Gluntz | 417/151 |
| 4,151,259 | 4/1979 | Fisher | 417/198 |
| 4,482,299 | 11/1984 | Eulass | 417/87 |
| 4,690,333 | 9/1987 | Johansson | 239/433 |
| 4,834,132 | 5/1989 | Sasaki et al. | 417/198 |
| 4,846,617 | 7/1989 | Ehrhardt | 417/151 |
| 4,847,043 | 7/1989 | Gluntz | 417/197 |

FOREIGN PATENT DOCUMENTS

| | | | |
|---|---|---|---|
| 975795 | 10/1950 | France | 417/198 |
| 2913960 | 10/1979 | Germany | 417/87 |
| 64-46500 | 3/1989 | Japan . | |
| 767405 | 9/1980 | U.S.S.R. | 417/151 |
| 1059281 | 12/1983 | U.S.S.R. | 417/198 |
| 1677377 | 9/1991 | U.S.S.R. | 417/151 |
| 1735611 | 5/1992 | U.S.S.R. | 417/151 |

*Primary Examiner*—Timothy Thorpe
*Assistant Examiner*—Ted Kim
*Attorney, Agent, or Firm*—Oblon, Spivak, McClelland, Maier & Neustadt, P.C.

[57] ABSTRACT

To ensure the effective recovery of the condensate from steam-using apparatus, together with leaked steam from the trap and residual air in the piping, a condensate recovering vacuum pump is equipped with a jet pump comprising a vacuum chamber into which a condensate inlet port opens, a convergent cylindrical segment opening into the vacuum chamber and having a constricting cross-sectional area, a throat segment adjoining the convergent cylindrical segment and having a substantially uniform cross-sectional area, a divergent segment flaring from the throat segment, and a nozzle having an orifice at the tip thereof that protrudes somewhat into the convergent cylindrical segment from the side of the vacuum chamber, with the inside wall of the tip of the nozzle flaring so that a jet stream expelled therefrom diverges toward the internal surface thereof near the rear end of the throat segment. The jet pump is disposed so that the feedwater ejected therefrom issues forth upward.

3 Claims, 3 Drawing Sheets

VACUUM JET PUMP FOR RECOVERING A MIXED FLUID OF GAS AND LIQUID CONDENSATES FROM STEAM-USING APPARATUS

This is a Continuation of application Ser. No. 08/277,210, filed on Jul. 19, 1994, now abandoned.

FIELD OF THE INVENTION

This invention relates to vacuum pumps for recovering liquid condensates from steam heaters, heat exchangers, air conditioners and other apparatuses using steam supplied from steam boilers.

DESCRIPTION OF THE PRIOR ART

Some apparatuses that use steam supplied from a steam boiler are designed to recover the steam after use. In an apparatus of this type, more specifically, a vacuum pump recovers the condensed steam from a steam trap and sends the recovered condensate back into the steam boiler.

Here it should be noted that the condensed steam from the steam trap is usually at as high a temperature as between approximately 90° and 110° C. This hot condensate, if recovered directly into the vacuum pump, might evaporate again or, otherwise, cause the raw steam leaked from the steam trap of air remained in the piping to flow into the vacuum pump, which could lead to malfunction or failure of the pump.

Japanese Provisional Utility Model Publication No. 46500 of 1989 discloses a condensate recovering vacuum pump that provides a solution for the problem just described. This pump is connected to a boiler and a condenser or other apparatus using steam, as will be described later by reference FIG. 1. A jet pump in this vacuum pump collects the condensate produced in the steam-using apparatus into a tank and sends the collected condensate back into the boiler as makeup water.

However, the jet pump of this vacuum pump not only collects the condensate from the steam-using apparatus but also entrains leaked steam and/or residual air in the piping. To enhance the performance of the condensate recovering vacuum pump, therefore, provision must be made for the jet pump to take in a mixed fluid of gas and liquid. However, conventional apparatuses have not given much consideration to this point.

SUMMARY OF THE INVENTION

This invention eliminates the above shortcomings in conventional condensate recovering vacuum pumps. A feature of the invention is to provide a condensate recovering vacuum pump that can effectively recover the condensate together with leaked steam from the trap of steam-using apparatus and residual air from their piping.

Another object of this invention is to provide a condensate recovering vacuum pump that is adapted to collect mixed fluid of gas and liquid including the condensate into a tank by moderately altering the internal structure of the jet pump based on the findings obtained from the inventor's long experimental studies.

Still another object of this invention is to provide a condensate recovering vacuum pump that effectively prevents the counter flow of gas in a jet pump that takes in a mixed fluid of gas and liquid.

In order to achieve the above objects, a condensate recovering vacuum pump according to this invention comprises a condensate tank that temporarily holds the condensate, a circulating pump that supplies the condensate from the condensate tank to a feedwater injection nozzle of the jet pump described next, and a jet pump that creates a negative pressure at a port through which the condensate is taken in by injecting the feedwater, sucks the condensate through the condensate inlet port connected to a steam trap of a steam-using apparatus, and delivers the condensate together with the feedwater through a discharge port into the condensate tank. The jet pump comprises a vacuum chamber into which the condensate inlet port opens, a convergent cylindrical segment opening into the vacuum chamber with the cross-sectional area thereof becoming smaller with the distance therefrom, a throat segment concentrically adjoining the convergent cylindrical segment and having a substantially uniform cross-sectional area, a divergent segment adjoining the throat segment and flaring with the distance therefrom, and a nozzle having an orifice at the tip thereof that protrudes somewhat into the convergent cylindrical segment from the vacuum chamber side, with the inside wall of the tip of the nozzle flaring so that a jet stream expelled therefrom diverges toward the internal surface thereof near the rear end of the throat segment. The jet pump is particularly effective when it is disposed so that the nozzle thereof expels the feed water upward.

When feedwater under high pressure is supplied from the circulating pump to the jet pump nozzle of a condensate recovering vacuum pump of the type just described, a negative pressure develops in the vacuum chamber, whereupon the condensate is drawn in through the inlet port and delivered into the tank, together with the feedwater, through the discharge port. In this instance, the jet pump described above is particularly effective in the suction of a mixed fluid of gas and liquid from the steam-using apparatus that contains not only the condensate but also leaked steam and/or residual air.

Generally, jet pumps that expel and suck water are considered to exhibit high efficiency when their nozzle tip inserted deep into the convergent cylindrical segment, whereas those ejecting water and sucking gas are said to function efficiently when their nozzle tip is allowed to open in the vacuum chamber. The nozzle tip of the jet pump of this invention is positioned at a point midway between the above two, somewhat protruding into the convergent cylindrical segment from the vacuum chamber side. In conjunction with other characteristic features, the nozzle tip of the jet pump of this invention thus positioned has empirically proved to assure efficient suction of a mixed fluid of gas and liquid.

The inside wall of the jet pump nozzle tip flares so that a jet stream expelled therefrom diverges toward the internal surface thereof near the rear end of the throat segment, as described before. Because of this design, the feedwater jet stream from the nozzle closes the rear end of the throat segment, thus eliminating any chance of forming a space through which the gas reaching the divergent segment could flow backward. The feedwater leaving the nozzle at high speed lowers the pressure in the surroundings. If, then, the vacuum chamber and the divergent segment communicate with each other through the medium of gas, the gas reaching the divergent segment flows backward into the vacuum chamber. If, however, the feedwater is expelled so as to close the rear end of the throat segment, such counterflow is prevented.

Diverging the jet stream from the nozzle toward the internal surface near the rear end of the throat segment restrains the feedwater from coming in direct contact with the throat segment and reducing its speed, thus effectively creating a higher vacuum.

When erected upright to allow the feedwater to issue forth upward from the nozzle, the jet pump of this invention effectively prevents the counterflow described before. If the jet pump is set in a horizontal position so that the jet stream from the nozzle thereof issues forth horizontally, the feedwater that has lost its speed in the divergent segment collects in the lower side thereof, as a result of which the gas collects in the upper side thereof to cause the divergent segment and vacuum chamber to communicate with each other to increase the possibility of the counterflow described before. When erected upright to allow the feedwater to issue forth upward, however, the jet pump of this invention prevents the collection of the feedwater in one side of the divergent segment and, thus, the occurrence of the counterflow.

Accordingly, the jet pump of this invention permits very effective suction of a mixed fluid of gas and liquid in the recovery of the condensate.

DESCRIPTION OF PREFERRED EMBODIMENTS

Figure 1:
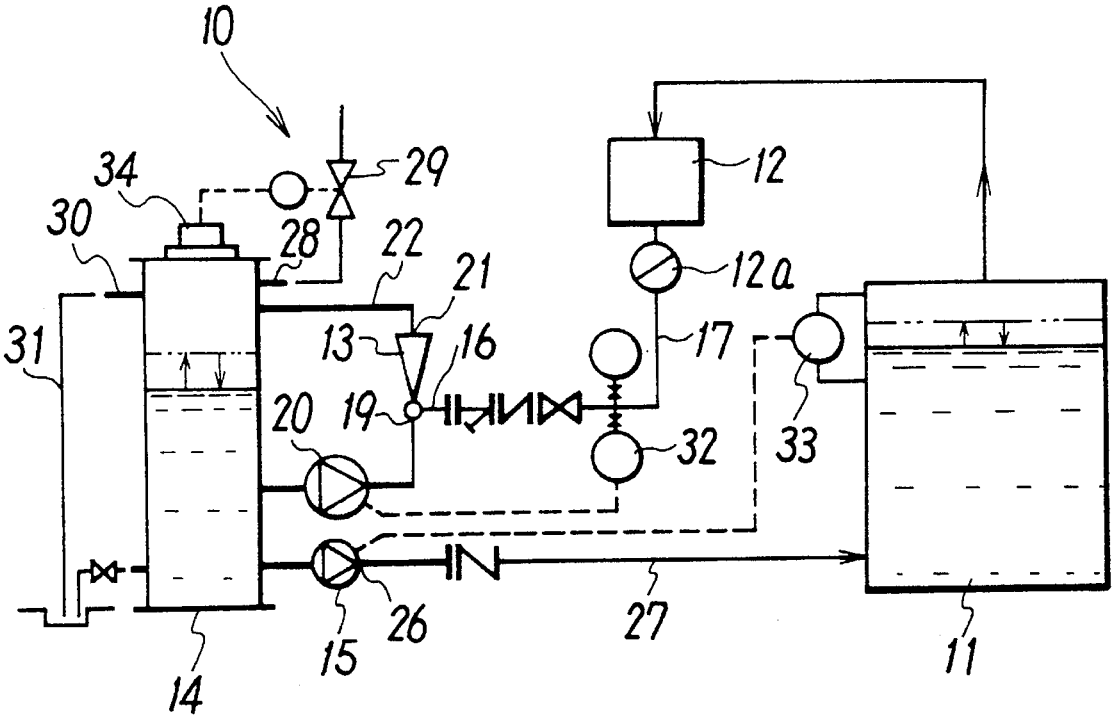
FIG. 1 is a block diagram showing a condensate recovering vacuum pump of this invention in use.

Connected to a boiler 11 and an apparatus 12, such as a condenser, that uses steam from the boiler 11, a condensate recovering vacuum pump of this invention designated by reference numeral 10 in FIG. 1 recovers the condensate produced in the steam-using apparatus 12 into a condensate tank 14 by means of a jet pump 13 and delivers the collected condensate back into the boiler 11 as the makeup water by means of a feedwater pump 15.

The way the condensate recovering vacuum pump 10, boiler 11 and steam-using apparatus 12 are connected will be described, together with the construction of the vacuum pump 10 shown in FIGS. 2 and 3. The jet pump 13 in the vacuum pump 10 has a condensate inlet port 16 that is connected to a trap 12*a* of the steam-using apparatus 12 through a suction pipe 17. The feed orifice 19 of a feedwater jet nozzle 18 is connected to the exhaust port of a circulating pump 20. The high-pressure feedwater from the circulating pump 20 is ejected through the nozzle 18 to create a negative pressure at the condensate inlet port 16. Then, the condensate from the trap 12*a* is drawn in through the inlet port 16 and discharged, together with the feed water, through the exhaust port 21.

A reflux pipe 22 connected to the side of the condensate tank 14 connects the exhaust port 21 to a space therein filled with gas. As is obvious from FIG. 3, two circulating pumps 20 are provided, one in front and the other at the back of the condensate tank 14, with one maintained as a spare. The feed orifice 19 is branched and connected to the exhaust port of each circulating pump 20 through a feedwater pipe 23 and a check valve 24. The inlet ports of the two circulating pumps 20 are connected to the lower end of a space of the condensate tank 14 filled with liquid through joints 25 projecting from the front and rear surfaces of the condensate tank 14.

Like the circulating pumps 20, two feedwater pumps 15 are provided, with one on stand-by. The exhaust ports 26 of the two feedwater pumps 15 are connected to the boiler 11 through feedwater pipes 27.

The condensate tank 14 has a makeup water port 28 that is connected to a source of makeup water through a solenoid valve 29 and an overflow port 30 that is connected to an overflow pipe 31. The signals from a vacuum switch 32 actuate the circulating pump 20 when the vacuum at the condensate inlet port 16 is low and stop it when the vacuum thereat is high. The signals from a boiler level gauge 33 actuates the feedwater pump 15 when the water level in the boiler 11 is low and stops it when the water level therein is high. The signals from a tank level gauge 34 opens the makeup water solenoid valve 29 when the water level in the condensate tank 14 is low and closes it when the water level therein is high.

Figure 2:
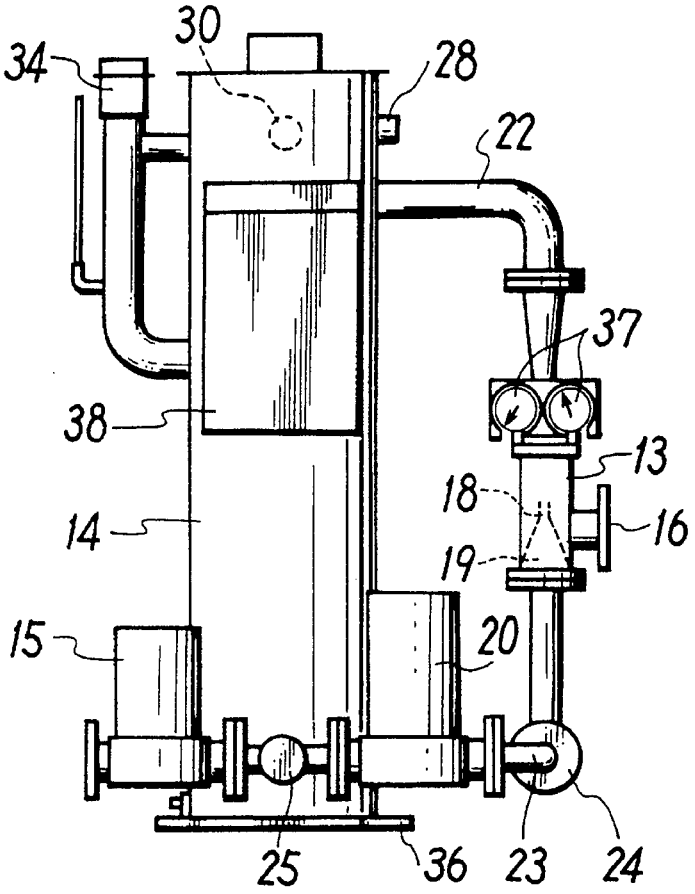
FIG. 2 is a front view showing an embodiment of the condensate recovering vacuum pump according to this invention.
Figure 3:
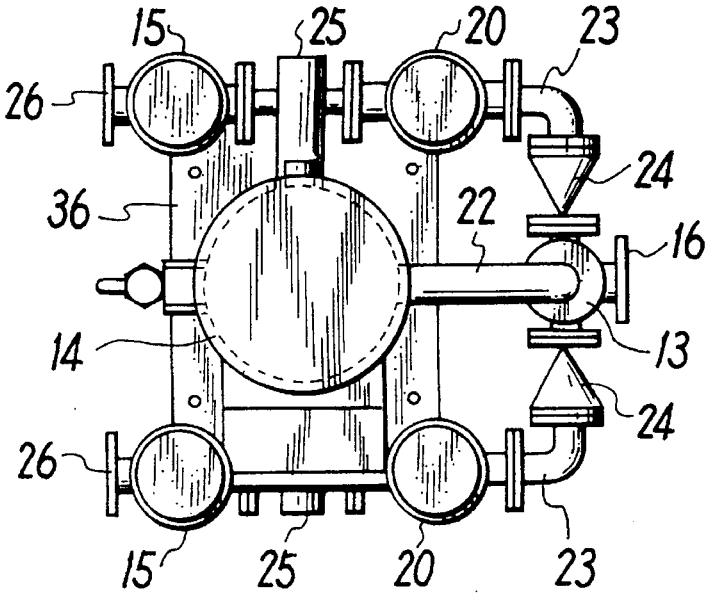
FIG. 3 is a plan view of the same embodiment.

As explicitly illustrated in FIGS. 1 and 2, the condensate tank 14 in the condensate recovering vacuum pump 10 is a cylindrical receptacle placed in an upright position on a seat 36. To the side of the condensate tank 14 whose inside is kept at normal pressure are connected the jet pump 13 to draw in the condensate, two circulating pumps 20 to supply the feedwater to the jet pump 13, and two feedwater pumps to supply the hot condensate from the condensate tank into the boiler 11 through pipes.

Connecting the two circulating pumps 20 and feedwater pumps 15 to the periphery of the lower end of the condensate tank 14 lowers the center of gravity of the vertically long condensate tank 14, thereby increasing the stability of the vacuum pump 10.

Reference numerals 37 and 38 respectively denote pressure gauges and a control panel to control the pumps described above.

In the condensate recovering vacuum pump just described, the steam generated in the boiler 11 is sent first to the steam-using apparatus for the liberation of heat, and then to the steam trap for condensation. When the feedwater at high pressure is supplied from the circulating pump 20 to the feed orifice 19 of the jet pump 13, a negative pressure develops at the condensate inlet port 16, whereupon the condensate is drawn from the steam trap 12*a* through the suction pipe 17 and then collected from the exhaust port 21, together with the feedwater, into the condensate tank 14 through the reflux pipe 22.

Because the condensate tank 14 is vertically long and the circulating pumps 20 are connected to the lower end of the water-filled zone therein, the pressure head therein prevents pressure drop in the vicinity of the inlet port of the circulating pump 20 and significantly lowers the chance of cavitation. The heat release in the condensate tank 14 at normal pressure lowers the temperature of the hot condensate collected therein. Then, the cooled condensate moves to the lower part of the condensate tank 14 by convection. The jet pump 13 thus supplied with the cooled condensate as the feedwater works very efficiently. Also a high vacuum can be created in the suction pipe 17 by adjusting the feedwater ejected through the nozzle 18. This assures the collection of not only the condensate at high temperatures (not lower than 100°C. ) but also leaked steam, residual air and/or reflashed steam.

Although the embodiment just described has two each circulating pumps 20 and feedwater pumps 15, their number may be reduced to one each.

Figure 4:
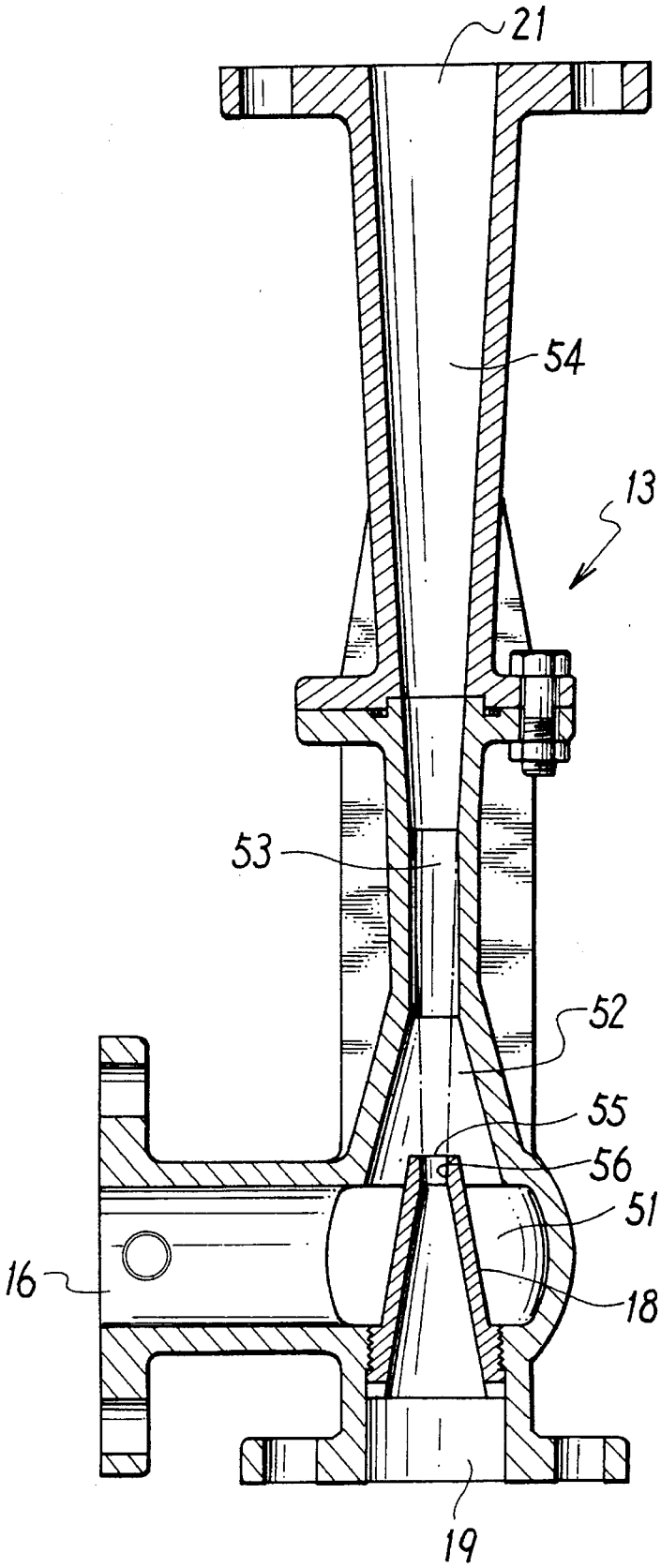
FIG. 4 is a cross-sectional view of a jet pump used in the condensate recovering vacuum pump according to this invention.

FIG. 4 shows the details of the jet pump 13 used in the condensate recovering vacuum pump 10 just described.

The illustrated jet pump 13 comprises a vacuum chamber 51 into which the condensate inlet port 16 opens, a convergent cylindrical segment 52 that opens into the vacuum chamber 51 and has a cross-sectional area that becomes smaller with the distance from the vacuum chamber 51, a throat segment 53 concentrically adjoining the convergent cylindrical segment and having a substantially uniform cross-sectional area, a divergent segment 54 adjoining the throat segment and flaring with the distance therefrom, and a feedwater jet nozzle 18. The nozzle 18 has an orifice 55 at the tip thereof that protrudes somewhat into the convergent cylindrical segment 52 from the side of the vacuum chamber 51, with the inside wall 56 of the tip of the orifice 55 flaring so that a jet stream expelled therefrom diverges toward the internal surface thereof near the rear end of the throat segment 53.

The jet pump 13 is placed upright so that the feedwater comes forth upward from the feedwater jet nozzle 18.

The jet pump 13 just described effectively collects not only the condensate but also a mixed fluid of gas and liquid, which contains leaked steam and residual air, from the steam-using apparatus.

Generally, jet pumps that expel and suck water are considered to exhibit high efficiency when their nozzle tip is inserted deep into the convergent cylindrical segment 52, whereas those ejecting water and sucking gas are said to function efficiently when their nozzle tip is allowed to open in the vacuum chamber 51. The orifice 55 of the jet pump 13 just described is positioned at a point midway between the above two, somewhat protruding into the convergent cylindrical segment 52 from the side of the vacuum chamber 51. In conjunction with other characteristic features, the jet pump of this invention assures efficient suction of a mixed fluid of gas and liquid.

The inside wall 56 of the orifice 55 flares so that a jet stream expelled therefrom diverges toward the internal surface thereof near the rear end of the throat segment 53, as indicated by a dot-dash line in FIG. 4.

The feedwater jet stream from the nozzle 18 closes the rear end of the throat segment 53, thus eliminating any chance of forming a space through which the gas reaching the divergent segment 54 could flow backward.

The feedwater leaving the nozzle 18 at high speed lowers the pressure in the surroundings. If, then, the vacuum chamber 51 and the divergent segment 54 communicate with each other through the medium of gas, the gas reaching the divergent segment 54 flows backward into the vacuum chamber 51. If, however, the feedwater is expelled so as to close the rear end of the throat segment 53, such counterflow is prevented.

Diverging the jet stream from the nozzle 18 toward the internal surface near the rear end of the throat segment 53 restrains the feedwater from coming in direct contact with the throat segment 53 and reducing its speed, thus effectively creating a higher vacuum.

When erected upright to allow the feedwater to issue forth upward from the nozzle 18, the jet pump 13 just described effectively prevents the counterflow described before. If the jet pump 13 is set in a horizontal position so that the jet stream from the nozzle 18 thereof issues forth horizontally, the feedwater that has lost its speed in the divergent segment 54 collects in the lower side thereof, as a result of which the gas collects in the upper side thereof to cause the divergent segment 54 and vacuum chamber 51 to communicate with each other to increase the possibility of the counterflow described before. When erected upright to allow the feedwater to issue forth upward, however, the jet pump 13 prevents the collection of the feedwater in one side of the divergent segment 54 and, thus, the occurrence of the counterflow.

Accordingly, the jet pump 13 permits very effective suction of a mixed fluid of gas and liquid in the recovery of the condensate.

What is claimed is:

1. A condensate recovering vacuum pump comprising: a condensate tank for collecting and temporarily holding a condensate, a circulating pump for supplying the collected condensate from the condensate tank to a feedwater nozzle of a jet pump, and a jet pump that creates a negative pressure at a port through which the condensate is taken in by injecting the feedwater, sucking the condensate through a condensate inlet port connected to a steam trap of a steam-using apparatus, and delivering the condensate together with the feedwater through a discharge port into the condensate tank, the condensate inlet port receiving a mixed fluid of gas and liquid containing leaked steam, residual air, and the condensate, wherein the jet pump comprises: a vacuum chamber into which the condensate inlet port opens; a convergent cylindrical segment opening into the vacuum chamber with a cross-sectional area thereof becoming smaller with a distance therefrom; a throat segment concentrieally adjoining the convergent cylindrical segment and having a substantially uniform cross-sectional area; and a divergent segment adjoining the throat segment and flaring with a distance therefrom; the nozzle having an orifice at a tip thereof that protrudes slightly into the convergent cylindrical segment from a vacuum chamber side, with an inside wall of the tip of the nozzle conically flaring so that an imaginary extension therefrom contacts an internal surface of the throat segment adjacent to a rear end of said throat segment such that feedwater expelled from the feedwater nozzle creates a fluid seal.

2. The condensate recovering pump according to claim 1, in which the jet pump is disposed so that the feedwater from the nozzle thereof issues forth upward.

3. A condensate recovering vacuum pump comprising: a circulating pump for supplying the collected condensate from the condensate tank to a feedwater nozzle of a jet pump; and a jet pump that creates a negative pressure at a port through which the condensate is taken in by injecting the feedwater, sucking the condensate through a condensate inlet port connected to a steam trap of a steam-using apparatus, and delivering the condensate together with the feedwater through a discharge port into the condensate tank, the condensate inlet of said jet pump receiving a mixed fluid of gas and liquid containing leaked steam residual air and the condensate; wherein the jet pump comprises: a vacuum chamber into which the condensate inlet port opens; a convergent cylindrical segment opening into the vacuum chamber and having a cross-sectional area which becomes smaller in a direction away from the vacuum chamber; a throat segment concentrically adjoining the convergent cylindrical segment and having a substantially uniform cross-sectional area; and a divergent segment adjoining the throat segment and flaring in a direction away from the throat segment; said feedwater nozzle extending through said vacuum chamber and having an orifice at a tip thereof that protrudes slightly into the convergent cylindrical segment, an inside wall of the tip of the nozzle conically flaring so that an imaginary extension therefrom contacts an internal surface of the throat segment adjacent to a rear end of the throat segment such that feedwater expelled from the feedwater nozzle creates a fluid seal.

* * * * *